US011230747B2

(12) United States Patent
Fukuda et al.

(10) Patent No.: US 11,230,747 B2
(45) Date of Patent: Jan. 25, 2022

(54) METHOD OF QUENCHING STEEL PIPE, APPARATUS FOR QUENCHING STEEL PIPE, METHOD OF MANUFACTURING STEEL PIPE AND FACILITY FOR MANUFACTURING STEEL PIPE

(71) Applicant: JFE Steel Corporation, Tokyo (JP)

(72) Inventors: Hiroyuki Fukuda, Fukuyama (JP); Hideo Kijima, Chiba (JP)

(73) Assignee: JFE Steel Corporation, Tokyo (JP)

( * ) Notice: Subject to any disclaimer, the term of this patent is extended or adjusted under 35 U.S.C. 154(b) by 649 days.

(21) Appl. No.: 15/544,382

(22) PCT Filed: Jan. 6, 2016

(86) PCT No.: PCT/JP2016/000030
§ 371 (c)(1),
(2) Date: Jul. 18, 2017

(87) PCT Pub. No.: WO2016/125425
PCT Pub. Date: Aug. 11, 2016

(65) Prior Publication Data

US 2017/0349965 A1 Dec. 7, 2017

(30) Foreign Application Priority Data

Feb. 6, 2015 (JP) ..... JP2015-022230

(51) Int. Cl.
*C21D 9/08* (2006.01)
*C21D 1/18* (2006.01)
(Continued)

(52) U.S. Cl.
CPC ..... *C21D 9/085* (2013.01); *B21B 23/00* (2013.01); *B21B 45/02* (2013.01);
(Continued)

(58) Field of Classification Search
None
See application file for complete search history.

(56) References Cited

U.S. PATENT DOCUMENTS 2,776,230 A * 1/1957 Scott ..... C21D 9/085 148/590
2,879,192 A * 3/1959 Gogan ..... C21D 1/62 148/644
(Continued)

FOREIGN PATENT DOCUMENTS

JP 54-18411 A 2/1979
JP 7-48620 A 2/1995
(Continued)

OTHER PUBLICATIONS

Knotted fields and explicit fibrations for lemniscate knots—Scientific Figure on ResearchGate. Available from: https://www.researchgate.net/figure/Closing-a-helical-braid-on-a-cylinder-to-a-torus-knot-a-The-strands-of-the-2-strand_fig5_309766514 [accessed Nov. 22, 2019] (Year: 2016).*
(Continued)

*Primary Examiner* — Patricia L. Hailey
*Assistant Examiner* — Christopher D. Moody
(74) *Attorney, Agent, or Firm* — DLA Piper LLP (US)

(57) ABSTRACT

A method quenches a steel pipe and an apparatus quenches a steel pipe by which a steel pipe having excellent and uniform quality can be acquired by applying uniform rapid cooling to the steel pipe in a longitudinal direction as well as in a circumferential direction of the steel pipe using a simple unit. Movements of a heated steel pipe in a direction parallel to and in a direction perpendicular to a pipe axis of the steel pipe are stopped, and cooling water is jetted onto an outer surface of the steel pipe from four or more spray
(Continued)

nozzles arranged spirally outside the steel pipe while rotating the steel pipe about the pipe axis.

18 Claims, 6 Drawing Sheets

(51) Int. Cl.

| | |
|---|---|
| ***C21D 1/667*** | (2006.01) |
| ***C21D 1/00*** | (2006.01) |
| ***B21B 45/02*** | (2006.01) |
| ***B21B 23/00*** | (2006.01) |

(52) U.S. Cl.
CPC ..... *B21B 45/0233* (2013.01); *C21D 1/00* (2013.01); *C21D 1/18* (2013.01); *C21D 1/667* (2013.01); *C21D 9/08* (2013.01)

(56) References Cited

U.S. PATENT DOCUMENTS

| | | | | |
|---|---|---|---|---|
| 3,189,490 | A * | 6/1965 | Scott | C21D 1/667 148/590 |
| 3,407,099 | A * | 10/1968 | Schell | C21D 9/085 148/590 |
| 3,671,028 | A * | 6/1972 | Hemsath | B21B 45/0215 266/134 |
| 3,889,507 | A * | 6/1975 | Kranenberg | B21B 1/18 72/201 |
| 3,997,376 | A * | 12/1976 | Hemsath | C21D 1/667 134/36 |
| 4,065,252 | A * | 12/1977 | Hemsath | C21D 1/667 432/77 |
| 4,204,880 | A * | 5/1980 | Schwitzgobel | B21B 45/0203 134/32 |
| 4,444,556 | A * | 4/1984 | Andersson | C21D 1/667 266/113 |
| 4,834,344 | A | 5/1989 | Hoetzl et al. | |
| 2013/0160903 | A1 | 6/2013 | Seo | |
| 2014/0007994 | A1 | 1/2014 | Sakamoto et al. | |
| 2017/0283898 | A1 * | 10/2017 | Della Putta | C21D 9/08 |

FOREIGN PATENT DOCUMENTS

| | | | |
|---|---|---|---|
| JP | 3624680 | B2 | 3/2005 |
| JP | 2005-298861 | A | 10/2005 |
| JP | 5071537 | B2 | 11/2012 |
| JP | 2015-67838 | A | 4/2015 |
| WO | 2012/127811 | A1 | 9/2012 |
| WO | 2016/035103 | A1 | 3/2016 |

OTHER PUBLICATIONS

Mascarenhas et al., "Analytical and computational methodology for modeling spray quenching of solid alloy cylinders," International Journal of Heat and Mass Transfer, vol. 53, Issues 25-26, 2010, pp. 5871-5883, ISSN 0017-9310, https://doi.org/10.1016/j.ijheatmasstransfer.2010.06.055. (Year: 2010).*

Supplementary European Search Report dated Dec. 12, 2017, of corresponding European Application No. 16746259.7.

European Office Action dated Aug. 10, 2018, from counterpart European Patent Application No. 16746259.7.

Chinese Office Action dated Jan. 14, 2019, from counterpart Chinese Application No. 201680008575.5, along with a Concise Statement of Relecance of Office Action in English.

Chinese Office Action dated Apr. 23, 2018, from corresponding Chinese Patent Application No. 20168008575.5, including a concise statement of relevance of Office Action in English.

Chinese Office Action dated Jun. 21, 2019, from counterpart Chinese Application No. 201680008575.5, along with a Concise Statement of Relevance of Office Action in English.

* cited by examiner

PRIOR ART

METHOD OF QUENCHING STEEL PIPE, APPARATUS FOR QUENCHING STEEL PIPE, METHOD OF MANUFACTURING STEEL PIPE AND FACILITY FOR MANUFACTURING STEEL PIPE

TECHNICAL FIELD

This disclosure relates to a method of quenching a steel pipe where quenching is performed by rapidly cooling a heated steel pipe, an apparatus for quenching a steel pipe, a method of manufacturing a steel pipe and a facility for manufacturing a steel pipe.

BACKGROUND

Conventionally, a steel pipe (for example, a seamless steel pipe, an electric resistivity welded steel pipe or the like) has been used in various applications, and properties to be satisfied by the steel pipe (for example, strength, toughness and the like) are prescribed corresponding to the application. A quenching apparatus is provided along with a steel pipe manufacturing line and, to acquire a steel pipe having predetermined properties corresponding to the application, quenching is performed after the steel pipe is manufactured or in the course of manufacturing the steel pipe.

For example, in a seamless steel pipe manufacturing line, a technique has been developed where piercing rolling is performed in hot working, crystal grains are made fine by performing elongation rolling in a non-recrystallization temperature region thus enhancing toughness and, subsequently, after elongation rolling is finished, quenching is performed by rapidly cooling a high-temperature seamless steel pipe (hereinafter, such quenching being referred to as direct quenching). Further, a technique has also been developed where a high-temperature seamless steel pipe discharged from a manufacturing line is cooled to room temperature and, thereafter, quenching is performed by reheating the steel pipe by a heating furnace.

With respect to an electric resistivity welded steel pipe, quenching is performed by heating an electric resistivity welded steel pipe of room temperature discharged from a manufacturing line by a heating furnace.

While various quenching techniques have been put into practice in this manner, in all quenching techniques, tempering is performed after quenching is performed to enable the steel pipe to acquire predetermined properties, (that is, strength, toughness and the like).

However, even when a temperature of a steel pipe before quenching is uniform, when the steel pipe is not uniformly rapidly cooled so that temperature irregularities occur in quenching, a steel pipe having uniform properties cannot be acquired. A steel pipe having irregularities in properties due to quenching can hardly eliminate such irregularities even when tempering is applied to the steel pipe after quenching.

In view of such circumstances, in performing quenching of a steel pipe, a technique for uniformly rapidly cooling a high-temperature steel pipe has been studied.

For example, Japanese Patent No. 5071537 discloses a technique where, in a state where a heated steel pipe is immersed in water, water flow is generated in a direction parallel to a pipe axis of the steel pipe (a longitudinal direction of the steel pipe) thus enabling uniform rapid cooling in the longitudinal direction of the steel pipe. However, in such a technique, it is necessary to take the steel pipe out of the water after rapid cooling is finished and discharge water in the steel pipe. That is, it takes a long time until the steel pipe is fed to a next step after rapid cooling is finished. Hence, the steel pipe is cooled by water in the steel pipe during a period that water is discharged from the steel pipe whereby it is difficult to control the temperature of the steel pipe within a predetermined range prescribed in association with an operation in a next step. Further, it is inevitably necessary to install a device (for example, an arm or the like) for grasping a steel pipe and immersing the steel pipe at predetermined position in water. Hence, it is unavoidable that the construction of a quenching apparatus becomes complicated. Further, to realize uniform rapid cooling in the longitudinal direction of the steel pipe, it is necessary to generate a high-speed water flow. Hence, the facility cost is increased.

Japanese Patent No. 3624680 discloses a technique where an outer surface and an inner surface of a heated steel pipe are rapidly cooled by cooling water by rotating the steel pipe thus enabling uniform rapid cooling of the steel pipe in a circumferential direction. In that technique, however, the steel pipe is not immersed in water. Hence, as shown in FIG. 4, it is difficult to bring an upper portion of the inner surface of the steel pipe 1 into contact with cooling water 2. Hence, temperature irregularities occur in the steel pipe 1 in a circumferential direction thus giving rise to irregularities in quality. Further, as shown in FIG. 5, at an end portion of the steel pipe 1 on a spray nozzle 3 side, neither the upper portion of the inner surface nor a lower portion of the inner surface are brought into contact with cooling water 2. Hence, temperature irregularities occur in the steel pipe 1 in a longitudinal direction whereby irregularities in quality occur.

Japanese Unexamined Patent Application Publication No. 2005-298861 discloses a technique where, to rapidly cool an outer surface of a heated steel pipe, a plurality of spray nozzles are arranged in a circumferential direction of the steel pipe, and a refrigerant is jetted onto the outer surface of the steel pipe thus enabling uniform rapid cooling of the steel pipe in the circumferential direction. However, in such a technique, as described in FIG. 6, the plurality of spray nozzles 3 which jet the refrigerant are arranged on the same circumference. Hence, a ring-shaped high temperature portion and a ring-shaped low temperature portion are alternately generated.

Further, with the technique disclosed in Japanese Unexamined Patent Application Publication No. 2005-298861, rapid cooling may be performed while moving the steel pipe 1 in a longitudinal direction. When it is necessary to largely lower the temperature of the steel pipe 1, it is necessary to ensure a time for cooling by reducing a conveyance speed of the steel pipe 1 or extending a header 4 in the longitudinal direction of the steel pipe 1 and also extending a conveyance unit (not shown) along with the extension of the header 4. However, when the conveyance speed of the steel pipe 1 is lowered, heat is radiated from a trailing end portion of the steel pipe 1 in an advancing direction for a long time. Hence, a refrigerant is jetted after a state is brought about where a temperature of the steel pipe 1 falls below a prescribed value of a temperature for starting rapid cooling (hereinafter, referred to as cooling start temperature). As a result, irregularities in quality occur in the steel pipe 1. On the other hand, when the header 4 is extended, the facility cost is increased.

Japanese Unexamined Patent Application Publication No. S54-018411 discloses a technique where, to cool an outer surface of a heated steel pipe, a plurality of spray nozzles are mounted on a spiral header, and cooling water is jetted onto the outer surface of the steel pipe thus enabling uniform rapid cooling of the steel pipe in a longitudinal direction.

However, in such a technique, as shown in FIG. 7, a region where cooling water is jetted is limited. Hence, irregularities in temperature occur in the steel pipe 1. As a result, irregularities in quality occur in the steel pipe 1. Even when the pitch of the spiral header 4 is shortened to expand the region where cooling water is jetted, the smooth discharge of cooling water jetted onto the outer surface of the steel pipe 1 becomes difficult. Hence, irregularities in temperature occur in the same manner. As a result, irregularities in quality occur in the steel pipe 1.

It could therefore be helpful to provide a method of quenching a steel pipe where a steel pipe having excellent and uniform quality is acquired by uniformly rapidly cooling the steel pipe in a longitudinal direction and in a circumferential direction of the steel pipe using a simple unit, an apparatus for quenching a steel pipe, a method of manufacturing a steel pipe, and a facility for manufacturing a steel pipe.

SUMMARY

We studied techniques of performing uniform rapid cooling of a steel pipe in a longitudinal direction as well as in a circumferential direction by jetting cooling water onto an outer surface of the steel pipe from spray nozzles. We found that a steel pipe can be uniformly rapidly cooled by arranging spray nozzles properly and by jetting cooling water while rotating the steel pipe about a pipe axis.

We thus provide a method of quenching a steel pipe where movements of a heated steel pipe in a direction parallel to and in a direction perpendicular to a pipe axis of the heated steel pipe are stopped, and cooling water is jetted onto an outer surface of the steel pipe from four or more spray nozzles arranged spirally at equal intervals outside the steel pipe while rotating the steel pipe about the pipe axis. In such a quenching method, it is preferable that the number of spray nozzles be 6 or more.

In the quenching method, it is preferable that the spiral arrangement of spray nozzles be provided in two or more rows. That is, it is preferable to provide two spirals which do not overlap with each other. It is preferable that a rotational speed of the steel pipe be 5 rpm or more and 300 rpm or less. It is preferable that cooling water be jetted onto the outer surface of the steel pipe from the spray nozzles positioned on sides opposite to each other with respect to the pipe axis on a plane perpendicular to the pipe axis of the steel pipe.

We also provide an apparatus for quenching a steel pipe which includes: two or more rotating rolls provided for rotating a heated steel pipe about a pipe axis of the steel pipe; six or more spray nozzles arranged spirally at equal intervals outside the steel pipe rotated by the rotating rolls and provided for spraying cooling water; and two or more headers provided for supplying cooling water to the spray nozzles.

In the quenching apparatus, it is preferable that the headers be arranged parallel to the pipe axis, and the spray nozzles be mounted on the header at an equal pitch $P_{SN}$ (mm). That is, it is preferable that the plurality of headers extending in the pipe axis direction be arranged at the equal intervals outside the steel pipe, and out of the spray nozzles arranged spirally, the spray nozzles arranged adjacently to each other in a direction parallel to the pipe axis be mounted on the same header. It is preferable that when n pieces of spray nozzles is arranged (n directions) as viewed in cross section perpendicular to the pipe axis of the steel pipe, the number of rows of spirals where the spray nozzles are arranged be smaller than n. When the number of rows of the spiral is equal to n, the spray nozzles are arranged on the same circumference as shown in FIG. 6. Hence, a ring-shaped high temperature portion and a ring-shaped low temperature portion are alternately generated. The minimum number of rows of the spirals is 1. Further, it is preferable that the rotating roll is arranged between the spray nozzles at an equal pitch $P_{RL}$ (mm) in a direction parallel to the pipe axis of the steel pipe, and a $P_{RL}$ value satisfies the relationship of $P_{RL}$ (mm)=N×$P_{SN}$ with respect to an arbitrary integer N. It is preferable that the number of rows of spirals of the spray nozzles be two or more. It is preferable that the spray nozzles be arranged on sides opposite to each other with respect to the pipe axis on a plane perpendicular to the pipe axis of the steel pipe.

We further provide a method of manufacturing a steel pipe including a step of quenching a steel pipe by the above-mentioned quenching method.

We still further provide a facility for manufacturing a steel pipe including the above-mentioned quenching apparatus.

It is thereby possible to acquire a steel pipe having excellent and uniform quality by performing uniform rapid cooling in a longitudinal direction and in a circumferential direction of the steel pipe using a simple unit. Hence, we can acquire industrially outstanding advantageous effects.

BRIEF DESCRIPTION OF THE DRAWINGS

FIGS. 1A and 1B illustrate schematic views showing an example of an arrangement of spray nozzles of a quenching apparatus, wherein FIG. 1A is a cross-sectional view of the arrangement of the spray nozzles, and FIG. 1B is a side view of the arrangement of the spray nozzles. In the side view, only headers and nozzles positioned above and below a steel pipe are shown and other headers and nozzles are omitted.

FIGS. 2A and 2B illustrate schematic views showing an example of an arrangement of spray nozzles of a quenching apparatus, wherein FIG. 2A is a cross-sectional view of the arrangement of the spray nozzles, and FIG. 2B is a side view of the arrangement of the spray nozzles. In the side view, only headers and nozzles positioned above and below a steel pipe are shown and other headers and nozzles are omitted.

FIGS. 3A and 3B illustrate schematic views of an example where the steel pipe is rotated in the quenching apparatus shown in FIGS. 2A and 2B, wherein FIG. 3A is a cross-sectional view of the arrangement of the spray nozzles, and FIG. 3B is a side view of the arrangement of the spray nozzles. In the side view, only headers and nozzles positioned above and below a steel pipe are shown and other headers and nozzles are omitted.

In FIG. 6, only headers and nozzles positioned above and below a steel pipe are shown and other headers and nozzles are omitted.

REFERENCE SIGNS LIST

1: steel pipe
2: cooling water
3: spray nozzle
4: header
5: rotating roll

DETAILED DESCRIPTION

A type of steel pipe is not particularly limited, and steel pipe may be a seamless steel pipe, an electric resistivity welded steel pipe, an UOE steel pipe or the like, for example.

Figure 1A:
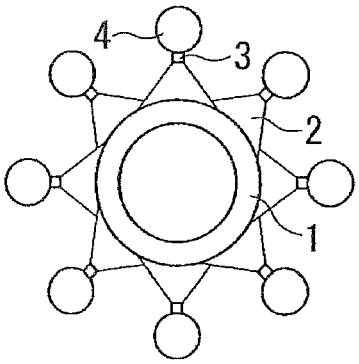
Figure 1B:
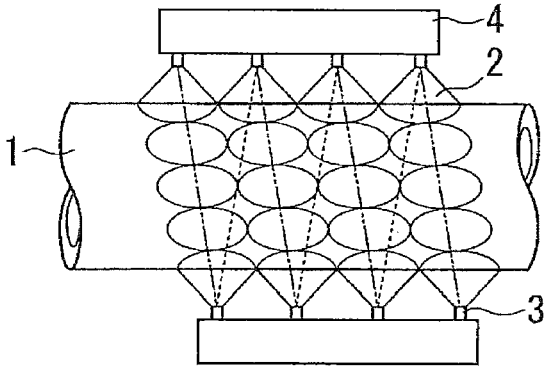

FIGS. 1A and 1B illustrate schematic views showing an example of an arrangement of spray nozzles of an apparatus for quenching a steel pipe, wherein FIG. 1A is a cross-sectional view of the arrangement of the spray nozzles taken along a plane perpendicular to a pipe axis, and FIG. 1B is a side view of the arrangement of the spray nozzles taken along a plane parallel to the pipe axis. In this example as viewed in the cross section perpendicular to the pipe axis of the steel pipe 1, the spray nozzles 3 are arranged outside the steel pipe 1 at equal intervals of 45° (see FIG. 1A). These spray nozzles 3 are arranged spirally in one row (see FIG. 1B). Accordingly, the total number of spray nozzles 3 is 8 or more. In FIG. 1B, FIG. 2B and FIG. 3B, to explain the spiral arrangement row in a simplified manner, some nozzles 3 and some headers 2 in a longitudinal direction of the steel pipe are shown.

As the spray nozzle 3, it is preferable that a spray nozzle can jet cooling water 2 in a range wider than a diameter of a jetting port, and the spray nozzles 3 are arranged such that jetting regions of cooling water 2 overlap with each other spirally (see FIG. 1A). The reason is that by making cooling water 2 jetted in a cone shape (including an approximately cone shape) overlap with each other spirally, a sufficient cooling rate can be ensured, and uniform rapid cooling can be performed by turning the steel pipe 1.

Figure 8:
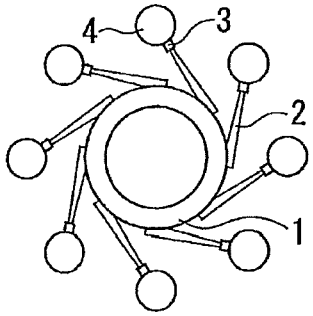
FIG. 8 is a side view schematically showing a conventional example where cooling water is jetted onto an outer surface of a steel pipe.

It is preferable that the spray nozzles 3 be arranged such that a center axis of the jetting port of the spray nozzle 3 intersects the pipe axis of the steel pipe 1 perpendicularly. The reason is that when cooling water 2 is jetted in a tangential direction of the steel pipe 1 (see FIG. 8) or in an oblique direction (not shown), cooling efficiency is lowered thus giving rise to a possibility that a sufficient cooling rate is hardly ensured.

As described previously, the spray nozzles 3 are arranged spirally at equal intervals outside the steel pipe. Accordingly, the plurality of spray nozzles 3 are arranged in a direction parallel to the pipe axis (see FIG. 1B). By arranging the spray nozzles 3 spirally, irregularities in cooling in a circumferential direction of the steel pipe 1 can be reduced. Camber of the steel pipe 1 caused by irregularities in cooling in the circumferential direction is dispersed in the circumferential direction. Hence, camber can be reduced over the whole length of the steel pipe 1. It is preferable that the headers 4 that supply cooling water 2 to the spray nozzles 3 are formed into an approximately straight pipe shape and arranged parallel to the pipe axis. The reason is that when the header 4 is arranged spirally, resistance of cooling water 2 flowing through the header 4 is increased. Hence, a pressure and a flow rate of cooling water 2 jetted from the spray nozzle 3 are changed. By forming the header 4 in an approximately straight pipe shape and by arranging the header 4 parallel to the pipe axis, it is unnecessary to prepare a ring-shaped or spiral-shaped header. Hence, it is also possible to suppress the installation cost to a low cost. By arranging the spray nozzles 3 at equal intervals in the direction parallel to the pipe axis, the steel pipe 1 can be uniformly rapidly cooled in a longitudinal direction of the steel pipe 1. Further, even when a longitudinal pitch of the spray nozzles 3 is shortened, compared to when the header 4 is arranged in a ring shape or a spiral shape, it is possible to ensure a gap between the respective headers 4. Hence, water after cooling falls downwardly whereby uniformity of cooling in the circumferential direction can be further enhanced.

With such a configuration, movements of the steel pipe 1 in a direction parallel to and in a direction perpendicular to the pipe axis of the steel pipe 1 are stopped at a predetermined position and rapid cooling can be performed while rotating the steel pipe 1 about the pipe axis. As a result, the steel pipe 1 can be cooled over the whole length simultaneously. Further, it is unnecessary to install a header or a conveyance unit having an excessively large length. Hence, uniform rapid cooling can be performed in the longitudinal direction and in the circumferential direction of the steel pipe 1 using a simple unit. "Movements of the steel pipe 1 in a direction parallel to and in a direction perpendicular to the pipe axis of the steel pipe 1 are stopped at a predetermined position" means that the steel pipe is not positively moved in the pipe axis direction and in the direction perpendicular to the pipe axis direction when the steel pipe is rapidly cooled. Vibrations of the steel pipe generated due to rotation of the steel pipe about the pipe axis and unavoidable unintended movements of the steel pipe in the pipe axis direction and in the direction perpendicular to the pipe axis direction that may be generated due to such vibrations are included in a state "movements of the steel pipe 1 in a direction parallel to and in a direction perpendicular to the pipe axis of the steel pipe 1 are stopped at a predetermined position".

When the rotational speed of the steel pipe 1 is excessively small, there is a possibility that elimination of irregularities in temperature in the circumferential direction of the steel pipe becomes difficult. On the other hand, when the rotational speed of the steel pipe 1 is excessively large, there is a possibility that the steel pipe 1 jumps out from the quenching apparatus. Accordingly, it is desirable to set the rotational speed of the steel pipe 1 to a value falling within a range from 5 rpm or more to 300 rpm or less. From a viewpoint of suppressing irregularities in temperature in a circumferential direction of the steel pipe, it is more desirable that the rotational speed be 10 rpm or more. It is more preferable that the rotational speed be 30 rpm or more. It is still further preferable that the rotational speed be 50 rpm or more. From a viewpoint of further reducing the possibility that the steel pipe jumps out from a quenching apparatus by suppressing excessive vibrations when the steel pipe rotates about the pipe axis, it is more preferable that the rotational speed be less than 300 rpm and it is further preferable that the rotational speed be 250 rpm or less. It is still further preferable that the rotational speed be 200 rpm or less.

Figure 2A:
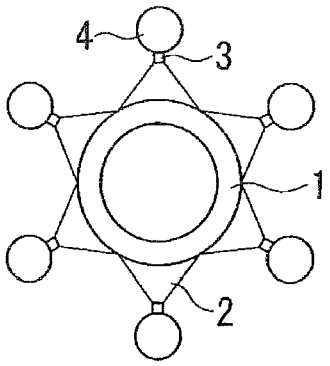
Figure 2B:
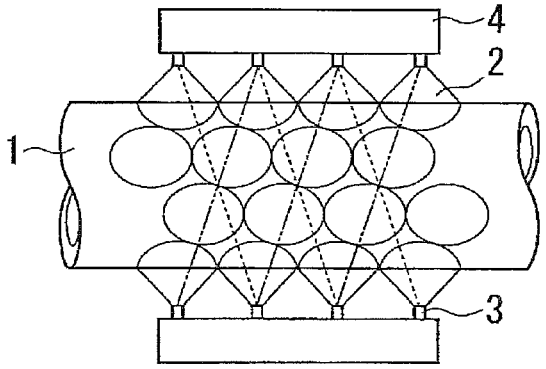

FIGS. 2A and 2B illustrate schematic views showing an example of an arrangement of spray nozzles of an apparatus for quenching a steel pipe, wherein FIG. 2A is a cross-sectional view of the arrangement of the spray nozzles taken along a plane perpendicular to a pipe axis, and FIG. 2B is a side view of the arrangement of the spray nozzles taken along a plane parallel to the pipe axis. In this example as viewed in the cross section perpendicular to the pipe axis of the steel pipe 1, six spray nozzles 3 are arranged outside the steel pipe 1 at equal intervals of 60° (see FIG. 2A). These spray nozzles 3 are arranged spirally in two rows (see FIG. 2B). Accordingly, the total number of spray nozzles 3 is 24 or more. In FIG. 2A and FIG. 2B, the spirals in two rows have the positional relationship that the spirals do not overlap with each other. Accordingly, the spray nozzles 3 arranged adjacent to each other on the header 4 form different spirals alternately. By setting the number of rows of spiral arrangements to two or more, irregularities in temperature in the circumferential direction can be further reduced.

As shown in FIGS. 2A and 2B, also in a quenching apparatus where the spray nozzles 3 are arranged in rows, as has been described already with reference to FIGS. 1A and 1B, it is preferable to use spray nozzles 3 that jet cooling water 2 in a conical shape and arrange the spray nozzles 3 such that a center axis of a jetting port of the spray nozzle intersects with a pipe axis of the steel pipe 1 perpendicularly. It is preferable that headers 4 that supply cooling water 2 to the spray nozzles 3 be arranged parallel to the pipe axis. Further, from a viewpoint of reducing camber of the steel pipe in the longitudinal direction of the steel pipe by enhancing cooling uniformity in the circumferential direction, it is preferable that, on a plane perpendicular to the pipe axis of the steel pipe, the spray nozzles are arranged at positions on sides opposite to each other with respect to the pipe axis, that is, the spray nozzles form pairs in an opposed manner with the pipe axis interposed therebetween. Further, in performing rapid cooling while rotating the steel pipe 1, in the same manner as shown in FIGS. 1A and 1B and described previously, it is preferable to set a rotational speed of the steel pipe 1 to 5 rpm or more to 300 rpm or less. That is, the example described previously with reference to FIGS. 1A and 1B can be also adopted as shown in FIGS. 2A and 2B. In FIGS. 2A and 2B, it is possible to jet cooling water to an outer surface of the steel pipe 1 from the spray nozzles 3 arranged on sides opposite to each other with respect to the pipe axis on a plane perpendicular to the pipe axis of the steel pipe 1 (that is, disposed away from each other by 180° with respect to the pipe axis).

Figure 3A:
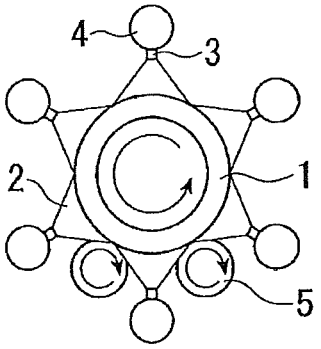
Figure 3B:
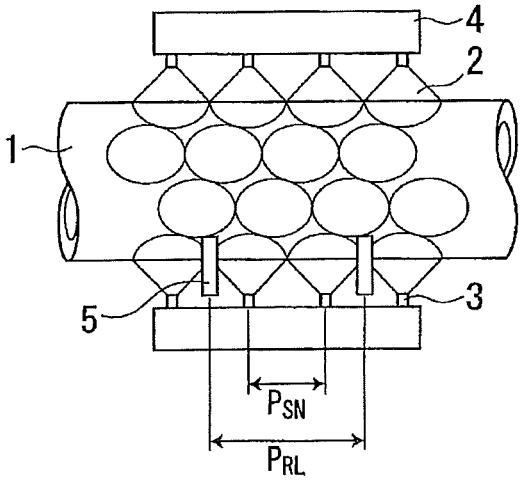

FIGS. 3A and 3B schematically illustrate views showing an example where rotating rolls are arranged in the apparatus for quenching a steel pipe shown in FIGS. 2A and 2B and the steel pipe is rotated, wherein FIG. 3A is a cross-sectional view of the arrangement of the spray nozzles, and FIG. 3B is a side view of the arrangement of the spray nozzles. In this example, a pair of (that is, two) rotating rolls 5 is arranged in cross section perpendicular to a pipe axis of the steel pipe 1, and the steel pipe 1 is rotated by placing the steel pipe 1 on the rotating rolls 5 (see FIG. 3A). It is difficult to place the steel pipe 1 on the rotating rolls 5 when only one pair of rotating rolls 5 is used. Hence, two or more pairs of rotating rolls 5 are arranged at an equal pitch in a direction parallel to the pipe axis of the steel pipe 1 (see FIG. 3B).

Assuming a pitch of the rotating rolls 5 as $P_{RL}$ (mm) and a pitch of spray nozzles 3 arranged on the header 4 as $P_{SN}$ (mm), it is preferable to arrange the rotating rolls 5 such that formula (1) is satisfied. In formula (1), N is an arbitrary integer. N can be suitably selected corresponding to the length of cooling water 2 in a pipe axis direction or a rotational ability of the rotating rolls 5 which rotate the steel pipe. When N becomes excessively large, rotational ability required for each rotating roll 5 becomes excessively large. Hence, facility cost is increased. Accordingly, it is preferable to set N to 5 or less. Further, the larger the number of rotating rolls 5 is, the more stable the rotation of the steel pipe becomes. Accordingly, a lower limit of N is 1.

$$P_{RL}=N\times P_{SN} \tag{1}$$

By setting the pitch $P_{RL}$ of the rotating rolls 5 and the pitch $P_{SN}$ of the spray nozzles 3 such that the pitches satisfy formula (1), as shown in FIG. 3B, the rotating rolls 5 can be arranged at positions where jetting regions of cooling water 2 overlap with each other. In the arrangement shown in FIG. 3B, the rolls 5 are positioned at the center of the pitch $P_{SN}$ of the spray nozzles 3. As a result, cooling water 2 smoothly flows without interfering with the rotating rolls 5. Hence, an effect of preventing irregularities in temperature is further enhanced.

Also when the rotating rolls are arranged in the apparatus for quenching a steel pipe shown in FIGS. 1A and 1B (not shown), it is preferable that the pitch $P_{RL}$ of the rotating rolls 5 and the pitch $P_{SN}$ of the spray nozzles 3 be set such that these pitches satisfy formula (1).

It is preferable that 2 to 32 spray nozzles be arranged at equal intervals on a cross section perpendicular to the pipe axis of the steel pipe. It is more preferable that 4 to 16 spray nozzles be arranged at equal intervals on a cross section perpendicular to the pipe axis of the steel pipe.

The number of spray nozzles may be suitably selected corresponding to a length of a steel pipe to be cooled. For example, when a length of a steel pipe is 4 to 8 m, it is preferable to set the number of spray nozzles to 8 to 1280.

By manufacturing a steel pipe using the method of quenching a steel pipe, a steel pipe can be more uniformly cooled than the prior art at the time of quenching. Hence, uniformity of a material of a steel pipe can be also enhanced. Accordingly, our method of quenching a steel pipe is desirable.

Our method of manufacturing a steel pipe has a technical feature in the above-mentioned step of quenching the steel pipe. Accordingly, other steps can be suitably selected by taking into account conditions, properties and the like of a steel pipe to be manufactured.

For example, in manufacturing a seamless steel pipe, the seamless steel pipe can be manufactured through a piercing rolling step, an elongation rolling step, a heat treatment step and the like.

For example, in manufacturing an electric resistivity welded steel pipe, the electric resistivity welded steel pipe can be manufactured through an uncoiling step, a forming step, a welding step, a heat treatment step and the like.

By manufacturing a steel pipe using a facility to manufacture a steel pipe including the apparatus for quenching a steel pipe, the steel pipe can be more uniformly cooled than the prior art. Hence, at the time of quenching, uniformity of a material of the steel pipe can be also enhanced. Accordingly, such manufacture of the steel pipe is preferable. The facility for manufacturing a steel pipe has the technical feature in the above-mentioned apparatus for manufacturing a steel pipe. Accordingly, other apparatuses can be suitably selected by taking into account conditions, properties and the like of a steel pipe to be manufactured.

Figure 9:
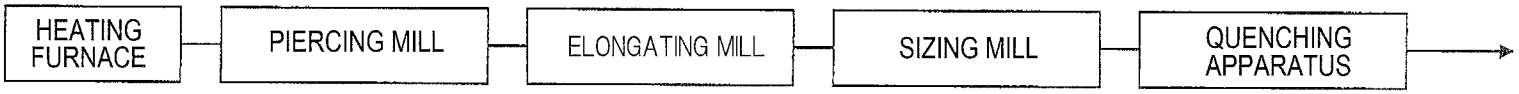
FIG. 9 is a view schematically showing an example of the construction of a facility for manufacturing a seamless steel pipe.

For example, when a seamless steel pipe is manufactured, as shown in FIG. 9, the apparatus for manufacturing a steel pipe includes a heating furnace, a piercing mill, an elongation mill and the like besides our quenching apparatus.

Figure 10:
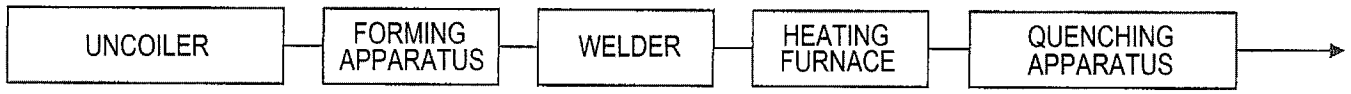
FIG. 10 is a view schematically showing an example of the construction of a facility for manufacturing electric resistivity welded steel pipe.

Further, for example, when an electric resistivity welded steel pipe is manufactured, as shown in FIG. 10, an apparatus for manufacturing a steel pipe includes an uncoiler, a forming apparatus, a welder, a heating furnace and the like besides our quenching apparatus.

EXAMPLES

Examples are described hereinafter. However, the technical scope of this disclosure is not limited by the following examples.

A direct quenching simulation test was carried out such that a seamless steel pipe (outer diameter: 210 mm, inner diameter: 130 mm, pipe thickness: 40 mm, pipe length: 8 m) was produced by applying piercing rolling to a billet heated by a heating furnace using a piercer testing machine and, subsequently, the seamless steel pipe was rapidly cooled by jetting cooling water (cooling start temperature: 1150° C., cooling stop temperature: 850° C.).

Hereinafter, the steps of the simulation test are described. In all examples, water quantity density of cooling water was set to 1 $m^3/(m^2 \cdot min)$, and other set conditions were set as shown in Table 1.

TABLE 1

| | Cooling | Nozzle: Interval on circumference (°) | Nozzle: The number of spiral rows | Nozzle: Pitch $P_{SN}$ (mm) | Nozzle: The number of nozzles | Rotational speed (rpm) | Interference between cooling water and roll | Temperature deviation (° C.): Longitudinal direction | Temperature deviation (° C.): Circumferential direction |
|---|---|---|---|---|---|---|---|---|---|
| Example 1 | outer surface | 90 | 1 | 300 | 112 | 10 | present | 18 | 17 |
| Example 2 | outer surface | 60 | 1 | 300 | 168 | 10 | present | 14 | 17 |
| Example 3 | outer surface | 45 | 1 | 300 | 224 | 10 | present | 12 | 17 |
| Example 4 | outer surface | 90 | 1 | 300 | 112 | 30 | present | 14 | 13 |
| Example 5 | outer surface | 90 | 2 | 300 | 112 | 30 | present | 14 | 10 |
| Example 6 | outer surface | 90 | 2 | 300 | 112 | 30 | not present | 10 | 11 |
| Example 7 | outer surface | 60 | 3 | 300 | 168 | 60 | not present | 8 | 7 |
| Example 8 | outer surface | 45 | 4 | 300 | 224 | 200 | not present | 5 | 3 |
| Comparison example 1 | inner surface | — | — | — | — | 60 | — | 150 | 25 |
| Comparison example 2 | outer surface | 45 | — | 300 | 224 | 0 | not present | 48 | 22 |

Example 1 is an example where spray nozzles were arranged at intervals of 90° as viewed in cross section perpendicular to a pipe axis of a steel pipe spirally in one row, and the steel pipe was rapidly cooled by jetting cooling water to an outer surface of the steel pipe while rotating the steel pipe. Rotational speed of the steel pipe was set to 10 rpm, and the total number of arranged spray nozzles set to 112 such that a pitch $P_{RL}$ of rotating rolls and a pitch $P_{SN}$ (=300 mm) of the spray nozzles do not satisfy formula (1) (that is, the rotating rolls and cooling water interfere with each other). After rapid cooling was stopped, a temperature of a seamless steel pipe was measured (8 places in the circumferential direction and 4 places in the longitudinal direction) using infrared thermometers. The difference between a maximum value and a minimum value is also shown in Table 1 as temperature deviation. As shown in Table 1, the temperature deviation in Example 1 is 18° C. in the longitudinal direction and 17° C. in the circumferential direction. That is, irregularities in temperature were suppressed to a value falling within an allowable range to acquire uniform properties (qualified when the temperature deviation in the longitudinal direction is 40° C. or below, qualified when the temperature deviation in the circumferential direction is 20° C. or below).

Example 2 is an example where spray nozzles were arranged at intervals of 60° as viewed in cross section perpendicular to a pipe axis of a steel pipe spirally in one row, and the steel pipe was rapidly cooled by jetting cooling water to an outer surface of the steel pipe while rotating the steel pipe. Rotational speed of the steel pipe was set to 10 rpm, and the total number of arranged spray nozzles set to 168 such that a pitch $P_{RL}$ of rotating rolls and a pitch $P_{SN}$ (=300 mm) of the spray nozzles do not satisfy formula (1). As a result, the temperature deviation after rapid cooling was 14° C. in the longitudinal direction and 17° C. in the circumferential direction. Since the number of spray nozzles was increased in Example 2, irregularities in temperature in the longitudinal direction were reduced compared to Example 1.

Example 3 is an example where spray nozzles were arranged at intervals of 45° as viewed in cross section perpendicular to a pipe axis of a steel pipe spirally in one row, and the steel pipe was rapidly cooled by jetting cooling water to an outer surface of the steel pipe while rotating the steel pipe. Rotational speed of the steel pipe was set to 10 rpm, and the total number of arranged spray nozzles set to 224 such that a pitch $P_{RL}$ of rotating rolls and a pitch $P_{SN}$ (=300 mm) of the spray nozzles do not satisfy formula (1). As a result, the temperature deviation after rapid cooling was 12° C. in the longitudinal direction and 17° C. in the circumferential direction. Since spray nozzles were arranged densely by further increasing the number of spray nozzles in Example 3, irregularities in temperature in the longitudinal direction were reduced compared to Example 2.

Example 4 is an example where spray nozzles were arranged at intervals of 90° as viewed in cross section perpendicular to a pipe axis of a steel pipe spirally in one row, and the steel pipe was rapidly cooled by jetting cooling water to an outer surface of the steel pipe while rotating the steel pipe. Rotational speed of the steel pipe was set to 30 rpm, and the total number of arranged spray nozzles set to 112 such that a pitch $P_{RL}$ of rotating rolls and a pitch $P_{SN}$ (=300 mm) of the spray nozzles do not satisfy formula (1). As a result, the temperature deviation after rapid cooling was 14° C. in the longitudinal direction and 13° C. in the circumferential direction. Since rotational speed of a steel pipe was increased in Example 4, irregularities in temperature in the longitudinal direction as well as in the circumferential direction were reduced compared to Example 1.

Example 5 is an example where spray nozzles were arranged at intervals of 90° as viewed in cross section perpendicular to a pipe axis of a steel pipe spirally in two rows. The spray nozzles of the respective spirals are arranged such that the spray nozzles face each other with respect to the pipe axis of the steel pipe in a plane perpendicular to the pipe axis, and this arrangement is repeated in the longitudinal direction. Example 5 is an example where the steel pipe was rapidly cooled by jetting cooling water to an outer surface of the steel pipe while rotating the steel pipe under such conditions. In other words, Example 5 is an example where the spray nozzles were arranged at positions opposite to each other with respect to the pipe axis in a plane which is perpendicular to the pipe axis direction of the steel pipe and includes the spray nozzles. Rotational speed of the steel pipe was set to 30 rpm, and the total number of arranged spray nozzles set to 112 such that a pitch $P_{RL}$ of rotating rolls and a pitch $P_{SN}$ (=300 mm) of the spray nozzles do not satisfy formula (1). As a result, the temperature deviation after rapid cooling was 14° C. in the longitudinal direction and 10° C. in the circumferential direction. Since the spray nozzles arranged spirally in two rows were more properly arranged and rotational speed of the steel pipe was increased in Example 5, camber of the steel pipe after cooling was reduced compared to Example 1.

Example 6 is an example where spray nozzles were arranged at intervals of 90° as viewed in cross section perpendicular to a pipe axis of a steel pipe spirally in two rows, the spray nozzles of the respective spirals are arranged such that the spray nozzles face each other with respect to the pipe axis of the steel pipe in a plane perpendicular to the pipe axis, and this arrangement is repeated in the longitudinal direction. Rotational speed of the steel pipe was set to 30 rpm, and the total number of arranged spray nozzles set to 112 such that a pitch $P_{RL}$ (=900 mm) of rotating rolls for rotating the steel pipe and a pitch $P_{SN}$ (=300 mm) of the spray nozzles satisfy formula (1) (that is, the rotating rolls and cooling water do not interfere with each other). As a result, the temperature deviation after rapid cooling was 10° C. in the longitudinal direction and 11° C. in the circumferential direction. Since the rotating rolls and cooling water do not interfere with each other in Example 6, irregularities in temperature in the longitudinal direction were reduced compared to Example 5.

Example 7 is an example where spray nozzles were arranged at intervals of 60° as viewed in cross section perpendicular to a pipe axis of a steel pipe spirally in three rows, and the steel pipe was rapidly cooled by jetting cooling water to an outer surface of the steel pipe while rotating the steel pipe. Rotational speed of the steel pipe was set to 60 rpm, and the total number of arranged spray nozzles set to 168 such that a pitch $P_{RL}$ (=1200 mm) of rotating rolls and a pitch $P_{SN}$ (=300 mm) of the spray nozzles satisfy formula (1). As a result, the temperature deviation after rapid cooling was 8° C. in the longitudinal direction and 7° C. in the circumferential direction. Since the spray nozzles are densely arranged by increasing the number of spray nozzles and rotational speed of a steel pipe was increased in Example 7, irregularities in temperature in the longitudinal direction as well as in the circumferential direction were reduced compared to Example 6.

Example 8 is an example where spray nozzles were arranged at intervals of 45° as viewed in cross section perpendicular to a pipe axis of a steel pipe spirally in four rows, and the steel pipe was rapidly cooled by jetting cooling water to an outer surface of the steel pipe while rotating the steel pipe. Rotational speed of the steel pipe was set to 200 rpm, and the total number of arranged spray nozzles set to 224 such that a pitch $P_{RL}$ (=1200 mm) of rotating rolls and a pitch $P_{SN}$ (=300 mm) of the spray nozzles satisfy formula (1). As a result, the temperature deviation after rapid cooling was 5° C. in the longitudinal direction and 3° C. in the circumferential direction. Since the spray nozzles are densely arranged by further increasing the number of spray nozzles and rotational speed of a steel pipe was further increased in Example 8, irregularities in temperature in the longitudinal direction as well as in the circumferential direction were reduced compared to Example 7.

Figure 4:
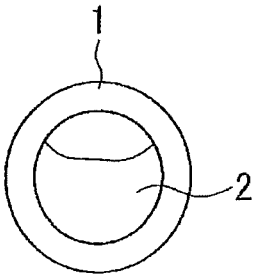
FIG. 4 is a cross-sectional view schematically showing a conventional example of cooling water flowing through the inside of a steel pipe.
Figure 5:
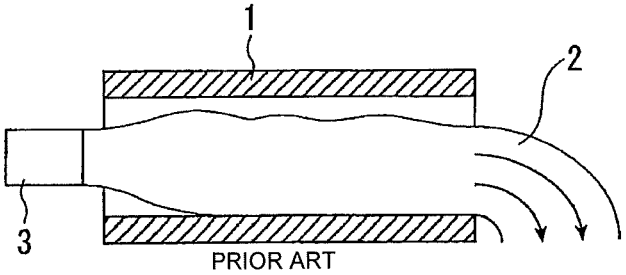
FIG. 5 is a cross-sectional view schematically showing a conventional example of cooling water flowing through the inside of a steel pipe.

Comparison example 1 is an example where an inner surface of a steel pipe is rapidly cooled by making cooling water flow through the steel pipe (see FIGS. 4 and 5). In this example, although the steel pipe was rotated, cooling water was not brought into contact with an upper portion of the inner surface, and cooling water was not brought into contact with an inner surface of a pipe end portion on a side where cooling water flows into the steel pipe. Accordingly, the temperature deviation after rapid cooling was 150° C. in the longitudinal direction and 25° C. in the circumferential direction. That is, the irregularities in temperature were largely increased compared to Examples 1 to 8.

Figure 6:
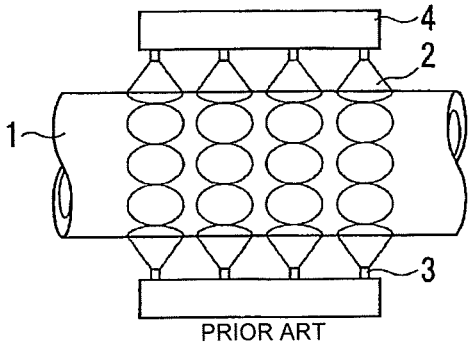
FIG. 6 is a side view schematically showing a conventional example where cooling water is jetted onto an outer surface of a steel pipe.
Figure 7:
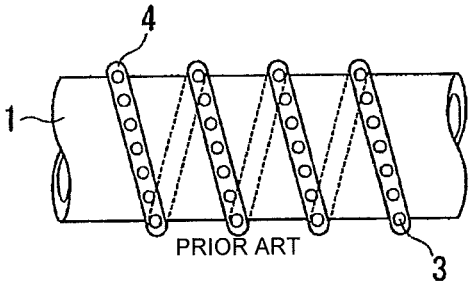
FIG. 7 is a side view schematically showing a conventional example where cooling water is jetted onto an outer surface of a steel pipe.

Comparison example 2 is an example where spray nozzles are arranged at intervals of 45° on the same circumference in cross section perpendicular to a pipe axis of a steel pipe, and 224 spray nozzles in total were arranged along a longitudinal direction of the steel pipe (see FIG. 6). In this example, a ring-shaped high-temperature portion and a ring-shaped low-temperature portion were generated alternately. Accordingly, the temperature deviation after rapid cooling was 48° C. in the longitudinal direction and 22° C. in the circumferential direction. That is, the irregularities in temperature were largely increased compared to Examples 1 to 8.

The invention claimed is:

1. A method of quenching a steel pipe comprising:

stopping movements of a moving heated steel pipe in a direction parallel to and in a direction perpendicular to a pipe axis of the steel pipe, and jetting cooling water onto an outer surface of a whole length of the steel pipe from six or more spray nozzles arranged helically at equal intervals outside the steel pipe such that jetting regions of the cooling water overlap with each other helically while rotating the steel pipe about the pipe axis, wherein two or more rotating rolls are provided to rotate a steel pipe about a pipe axis of the steel pipe, two or more headers are provided to supply cooling water to the spray nozzles, the headers are arranged substantially parallel to the pipe axis, and the spray nozzles are mounted on the header at an equal pitch $P_{SN}$, and the spray nozzles mounted on one of the headers and the spray nozzles mounted on another one of the headers are offset from each other in a direction of the pipe axis.

2. The method according to claim 1, wherein a helical arrangement of the spray nozzles is provided in two or more rows.

3. The method according to claim 2, wherein the cooling water is jetted onto the outer surface of the steel pipe from the spray nozzles positioned on sides opposite each other with respect to the pipe axis on a plane perpendicular to the pipe axis of the steel pipe.

4. The method according to claim 1, wherein a rotational speed of the steel pipe is 5 rpm or more and 300 rpm or less.

5. An apparatus for quenching a steel pipe comprising:

two or more rotating rolls that rotate the steel pipe about a pipe axis;

six or more spray nozzles arranged helically at substantially equal intervals outside the steel pipe rotated by the rotating rolls such that jetting regions of cooling water overlap with each other helically and provided to spray cooling water onto an outer surface of a whole length of the steel pipe; and two or more headers provided to supply cooling water to the spray nozzles, wherein the headers are arranged substantially parallel to the pipe axis, and the spray nozzles are mounted on the header at an equal pitch $P_{SN}$, and the spray nozzles mounted on one of the headers and the spray nozzles mounted on another one of the headers are offset from each other in a direction of the pipe axis.

6. The apparatus according to claim 5, wherein the two or more rotating rolls are arranged between the spray nozzles at an equal pitch $P_{RL}$ between two adjacent rotating rolls in a direction parallel to the pipe axis of the steel pipe, and a $P_{RL}$ value satisfies the relationship of $P_{RL}=N\times P_{SN}$ with respect to an arbitrary integer N.

7. The apparatus according to claim 5, wherein the number of rows of helices of the spray nozzles is two or more.

8. The apparatus according to claim 7, wherein the spray nozzles are arranged on sides opposite each other with respect to the pipe axis on a plane perpendicular to the pipe axis of the steel pipe.

9. A method of manufacturing a steel pipe comprising quenching a steel pipe by the method according to claim 1.

10. A facility for manufacturing a steel pipe comprising the apparatus according to claim 5.

11. The method according to claim 2, wherein a rotational speed of the steel pipe is 5 rpm or more and 300 rpm or less.

12. The method according to claim 3, wherein a rotational speed of the steel pipe is 5 rpm or more and 300 rpm or less.

13. The apparatus according to claim 6, wherein the number of rows of helices of the spray nozzles is two or more.

14. A method of manufacturing a steel pipe comprising quenching a steel pipe by the method according to claim 2.

15. A method of manufacturing a steel pipe comprising quenching a steel pipe by the method according to claim 3.

16. A method of manufacturing a steel pipe comprising quenching a steel pipe by the method according to claim 4.

17. A facility for manufacturing a steel pipe comprising the apparatus according to claim 7.

18. A facility for manufacturing a steel pipe comprising the apparatus according to claim 6.

* * * * *